United States Patent [19]

Vits

[11] 4,247,094

[45] Jan. 27, 1981

[54] SHEET PILER

[75] Inventor: Hilmar Vits, Leichlingen, Fed. Rep. of Germany

[73] Assignee: Vits Maschinenbau GmbH, Langenfeld, Fed. Rep. of Germany

[21] Appl. No.: 76,355

[22] Filed: Sep. 17, 1979

[30] Foreign Application Priority Data

Sep. 25, 1978 [DE] Fed. Rep. of Germany ..... 2841658

[51] Int. Cl.[3] ..... B65H 29/68

[52] U.S. Cl. ..... 271/183; 271/196

[58] Field of Search ..... 271/177, 178, 182, 183, 271/195, 196, 202, 231, 308

[56] References Cited

U.S. PATENT DOCUMENTS

| | | | |
|---|---|---|---|
| 3,096,978 | 7/1963 | Jendrusch | 271/202 X |
| 3,178,174 | 4/1965 | Schneider | 271/183 |
| 3,507,489 | 4/1970 | Wilshin et al. | 271/202 X |
| 3,941,374 | 3/1976 | Vits | 271/196 X |
| 4,019,731 | 4/1977 | Vits | 271/183 |

FOREIGN PATENT DOCUMENTS

| | | | |
|---|---|---|---|
| 852112 | 10/1960 | United Kingdom | 271/204 |

*Primary Examiner*—Richard A. Schacher
*Attorney, Agent, or Firm*—Kenyon & Kenyon

[57] ABSTRACT

A sheet piler for sheets transported end-to-end at high velocity, has a reciprocating suction bar for reducing the sheets' traveling velocity so that their forward travel can be stopped without damaging the sheets, with the stopped sheets forming a pile. Rotating brushes press the sheets' trailing ends momentarily against the suction bar and the latter then reduces the sheets' travel velocity.

6 Claims, 6 Drawing Figures

SHEET PILER

BACKGROUND OF THE INVENTION

Rotary crosscutters which cut the web delivered from high-speed web printing press, deliver horizontal sheets traveling at high velocity one at a time in end-to-end relationship and requiring stopping and piling for transport. Other equipment may also provide a corresponding delivery of flexible sheets requiring piling.

Such sheets have been delivered between horizontal high-speed conveyor belts which feed the sheets to a lower level horizontal comparatively low speed conveyor belt, with the sheets overlapping each other to compensate for the different traveling speeds involved. For the overlapping action, the trailing ends of the sheets are blown downwardly as they are fed to the low speed belt so that each succeeding sheet can overlap each preceding sheet. The intent is to reduce the sheets' traveling velocity so that without damage the sheets leading edges can strike an abutment beyond the end of the slow speed belt and fall one on top of another to form the pile.

The above technique has the disadvantage that neat piling is difficult or impossible to achieve when the sheets are delivered at high velocity and in closely interspaced end-to-end relationship, because it is a practical impossibility to keep the blowing air, which should act only on the trailing end of a preceding sheet, from blowing down the front end of a succeeding sheet. Another disadvantage is that the possible overlapping of the sheets does not permit operation of the low speed belt at a velocity low enough to positively prevent damage as the sheets' leading edges strike the abutment halting their travel.

With the intent of overcoming those disadvantages, such sheets have been delivered via pneumatic suspension bars which blow air over the tops of the sheets so that the sheets float spaced beneath the bars, with the sheets traveling as described at high velocity. A suction drum rotating at comparatively slow speed below the suspension bars slows each sheet by the sheet's trailing end being depressed into contact with the drum by depressing means positioned above the suspension bars and working downwardly between them. By appropriate timing mechanism, the trailing end of each sheet is pressed down on the suction drum which sucks only via an upper segment, the sheet being thus slowed and then released from the drum so that preceding sheets are overlapped by succeeding sheets.

However, when the sheets have lengths in the range of several meters and are delivered at high velocity, especially if heavy, impregnated or varnished sheets are involved, and such sheets must overlap each other over several meters for the piling, the rotary suction drum concept has substantial disadvantages, especially if electrostatic charges cause the sheets to tend to stick together. In particular, the depressing means cannot depress the trailing sheet ends and quickly enough get out of the way of the leading sheet ends of the overlapping sheets, and the suction drum cannot adequately grip and hold back the overlapped sheets.

The object of the present invention is to provide an improved sheet piler for the sheets traveling at high velocity one at a time and in end-to-end relationship beneath the horizontal suspension bars of the kind described, and which operates more effectively when the sheets are long, such as in the area of several meters long, and are possibly heavily impregnated or varnished.

SUMMARY OF THE INVENTION

According to the present invention, the horizontal sheets traveling at high velocity one at a time in end-to-end relationship beneath the suspension bars are decelerated by their trailing ends being brought into contact with a suction bar positioned transversely below the traveling sheets and which is provided with means for reciprocating the bar in a plane parallel to the sheets' traveling direction with at least the bars' forward stroke being of the desired lower velocity. Suction is applied to the bar only during its forward stroke. A rotative mount extends transversely above the sheets and suction bars, and a rotative depression means for successively depressing the trailing ends of the sheets into contact with the bar, is carried for planetary revolution by this mount. Means are provided for rotating the mount in synchronism with the sheets' travel and for causing the depressing means to orbitally rotate to sheet depressing positions only when the sheets' trailing ends travel above the suction bar during its forward stroke.

This rotative mount can be rotated so that its peripheral speed equals the traveling speed of the sheets. Planetary gearing can be used to synchronize or time the rotative depressing means so that it rotates during its planetary revolution by the mount, into contact only with the trailing sheet ends to press them against the suction bar. The timing can be such that the depressing means rotates the sheet depressing position only once for any multiple of rotations of the rotative mount which is keeping up with the high velocity travel of the sheets. Therefore, after each depressing action, the depressing means is very quickly removed from in front of the next oncoming sheet, and the means can stay out of the way for any number of revolutions by the mount, depending on the planetary system used.

Furthermore, the rotative mount can be designed as an open framework while the reciprocating suction bar can move arcuately so it can be mounted on pivoted arms and driven by a crank and connecting rod with the crank timed precisely with the rotative mount carrying the sheet depressing means orbitally. All of these parts are relatively open and easily accessible for servicing if needed. Because rotary motion is not involved, the suction bar can get such a good grip or hold on the trailing edge of each sheet as to permit it to have a reciprocatory motion of small stroke length, contributing to compactness of the device. With the sheet depressing means orbitally carried by the rotative mount and timed by planetary gearing synchronized with the reciprocation of the suction bar, excellent timing accuracy can be achieved which, in turn, means that the succession of sheets feeding at high velocity can be more closely interspaced end-to-end. Although the rotative mount can be driven to have a peripheral velocity equalling that of the high traveling velocity of the sheets, the sheet depressing means can be timed by its planetary gearing to rotate at a slower rotative velocity so as to contact only the trailing ends of the sheets.

DESCRIPTION OF THE DRAWINGS

The accompanying drawings schematically illustrate a specific example of the invention, the various figures being as follows.

DETAILED DESCRIPTION OF THE INVENTION

Figure 1:
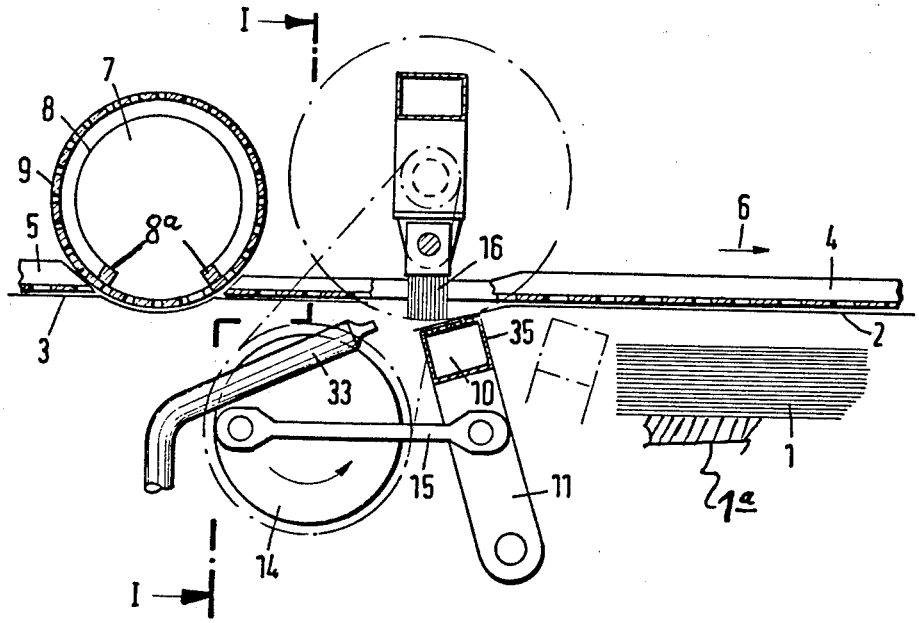
FIG. 1 is a side view.
Figure 2:
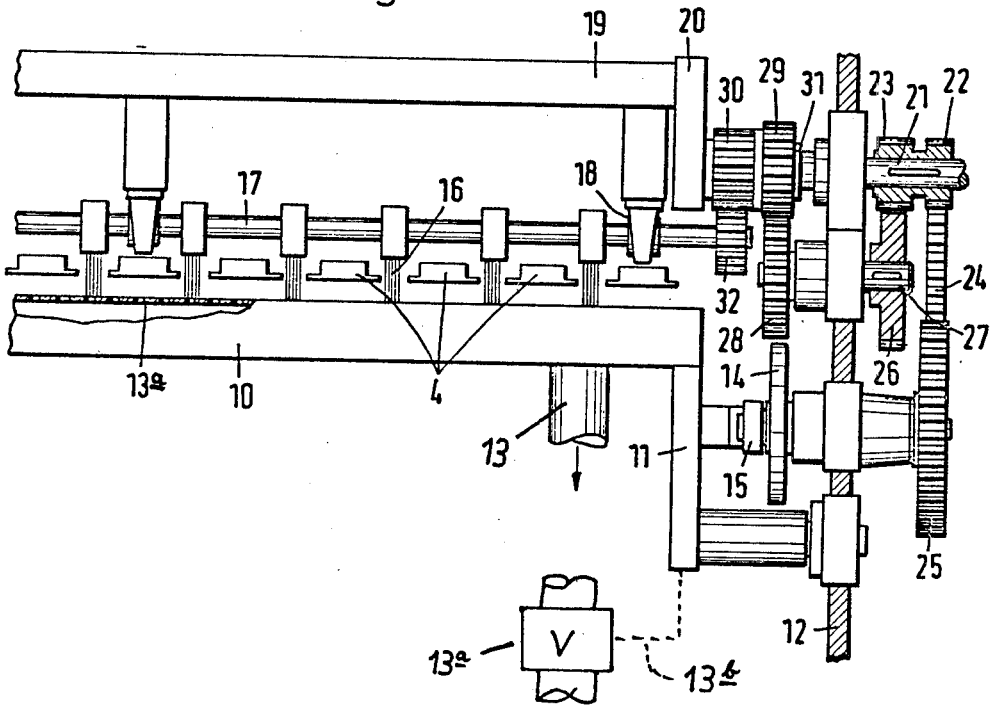
FIG. 2 is an end view taken on the line II—II in FIG. 1.

Having reference to FIGS. 1 and 2 of the above drawings, a forming sheet pile is shown at 1, the pile being supported by a support 1*a* which may be of the gradually descending type. One of the sheets is being decelerated while another sheet 3 is being fed forwardly at high velocity so as to ultimately overlap the sheet 2. The sheet 2 is floating pneumatically beneath the horizontal suspension bars 4, while the sheet 3 is being delivered via horizontal suspension bars 5.

The suspension bars are of known construction, the bars being laterally interspaced as shown by FIG. 2 and having flat bottom faces which eject high velocity air over the tops of the sheets in the direction of the arrow 6 so that the sheets float at spaced positions beneath the bars. Because the construction and operation is shown, these bars are not illustrated in detail. The air blasts in the direction of the arrow 6 not only pneumatically support the sheet spaced below the bars, but also drives the sheets forwardly.

The bars 4 and 5 are interspaced endwise to provide room for the suction transport cylinder 7 which comprises a stationary housing 8 to which suction is applied and a perforated jacket 9 which is rotatively driven, seals 8*a* making only the bottom periphery of the jacket 9 effective. The rotative velocity of the jacket 9 causes the sheets to travel forwardly at a constant velocity and avoids possible velocity variations in their travel.

The suction bar 10 is mounted to swing on arms 11 pivotally mounted by the piler's frame 12. This bar is formed by a square tube which is connected via a suction line 13 to a source of vacuum. The bar's flat top side is coated with a material 13*a* having a high static friction with the sheets being handled so as to increase the grip of the suction bar with the sheets.

A rotative crank 14 connects by a connecting rod 15 with the arm 11 mounting the suction bar 10. In this way the suction bar is reciprocated back and forth with an arcuate motion.

In this case the depressing means for the trailing ends of the sheets is provided by brushes 16 fixed on a planetary shaft 17 journaled at 18 on an axis offset from the axis of the rotative mount 19 which is in the form of a cross bar carried by offsetting arms 20 fixed to the sun shaft 21 of the planetary system.

Incidentally, it is to be understood that although FIG. 2 shows only one side of the piler, the opposite side can be a substantial duplicate to that shown.

The sun shaft 21 is journaled by the piler's frame 12 which is, of course, stationarily mounted.

The suction bar 10 and the brushes 16 which dip down between the suspension bars 4 to depress the trailing end of each sheet against the suction bar, must operate in synchronism. This is effected as explained below.

The machine is driven via rotary power applied to the sun shaft 21 and, therefore, the drive directly rotates the cross bar 19 via the crank arms 20, normally so that the peripheral speed of the mount is synchronized with the delivery speed and sequence of the sheets feeding to the piler via the suspension bars 5 and with the speed fixed by the suction drum 7 so as to eliminate variations in the speed pneumatically imparted to the sheets by the blasts of the suspension bars. Two pinions 22 and 23 are keyed to the sun shaft 21. The pinion 22 via a link belt chain drive 24 drives the gear 25 which drives the crank 14. Rotation of the crank 14, via the connecting rod 15, reciprocates the suction bar 10 forwardly and backwardly as indicated by broken lines in FIG. 1.

The pinion 23 drives a gear 26 keyed to a shaft 27 supported in the piler's frame 12 and which is keyed to a gear 28 which is in mesh with a smaller gear 29 which is fixed to a still smaller gear 30, both of the gears 29 and 30 being keyed to a bushing 31 rotatively mounted on the sun shaft 21. It is the gear 30 which is in mesh with the planetary gear 32 which drives the planetary shaft 17 on which the brushes 16 are fixed.

In operation, with rotative power applied to the sun shaft 21, the rotative mount provided by the cross bar 19 and arms or cranks 20 is rotated with a peripheral speed equalling the forward speed of the sheets being fed to the underside of the suspension bars 4 and floating in spaced relationship therebelow. Although the sheets are flexible, their momentum imparted by the suction drum 9, together with the transport action of the suspension bar air blasts, carries them forward. As with all sheet feeders, the drive applied to the sun shaft 21 should be synchronized with the feed of the oncoming sheets. The sheets traveling at high velocity are accommodated by the fact that the rotative mount 19–20 can have a peripheral speed that is the same.

Via the gear train 23, 26, 28 and 29, the sun gear 30 is rotated to drive the planet gear 32 which gives the brushes or sheet-depressing means the orbital action. Because the drive is mechanically locked in time throughout, the brushes 16 can be made to orbitally revolve to their sheet-depressing positions precisely as the trailing end of each sheet is above the suction bar 10 which is at that time in its retracted or left-hand position. Precision synchronism is made possible.

Depending on the gear ratios involved, the brushes 16 can be timed to orbitally rotate on their planetary shafts 17 any number of times, such as two or more, of the rotation of the rotative mount 19–20. Timing, obtained by the gear ratios involved, causes the brushes 16 to rotate to sheet-depressing positions when the suction bar 10 is retracted. With the rotative mount rotating in the traveling direction of the sheets, the brushes 16 orbitally rotate in the opposite direction so their rotative velocity relative to that of the mount 19–20 is more or less reduced relative to the suction bar 10. When rotated to their depressing position, the brushes 16 precisely wipe down the trailing end of each sheet onto the flat top of the suction bar 10 so that an extremely firm grip is obtained by the suction bar 10, possibly aided by its top being coated with a suitable material increasing the static friction between the sheet and the top of the bar as compared to that which would be obtainable from a plain flat metal surface.

The suction on the suction bar 10 must be released at the end of the bar's forward stroke to release the trailing end of each sheet, and this may be done in the usual manner as by a valve 13*a* timed to the reciprocating swinging of the arms or cranks 11 as indicated schematically by the broken line 13*b*.

Referring now to FIGS. 3–6, FIG. 3 shows how the sheet 2, supported by floating beneath the suspension bars 4, has driven between these bars and a sheet 34 which was previously fed to the pile. As the sheet 2 breaks the pneumatic action, the sheet 34 drops on the pile 1. The sheet 2 has just been gripped by the suction bar 10 on which the trailing end of the sheet 2 has been depressed by the brushes 16.

With the trailing end of the sheet 2 pressed downwardly onto the suction bar 10, this bar quickly gets a grip on the sheet and the sheet is decelerated to the velocity of the swinging motion of the suction bar 10. Because the brush 16 is being carried orbitally by the rotative mount 19–20 moving at the high velocity of the feeding sheets, the brushes get out of the way fast so that the next sheet 3 can follow very closely behind the sheet 2 without being impeded by the brushes 16 in any way.

Figure 4:
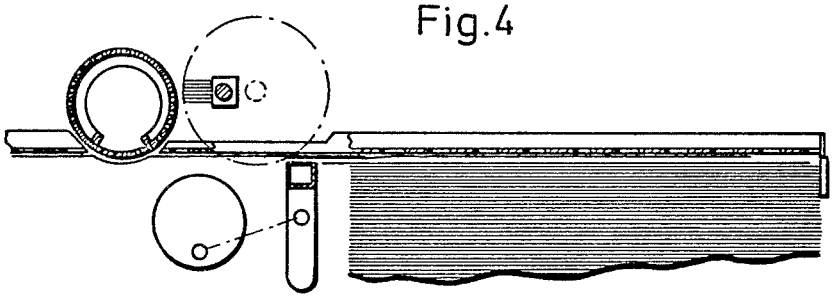

FIG. 4 shows that the overlap takes place halfway along the swinging motion of the suction bar 10, the brushes having left the vicinity of the suction bar safely prior.

Figure 3:
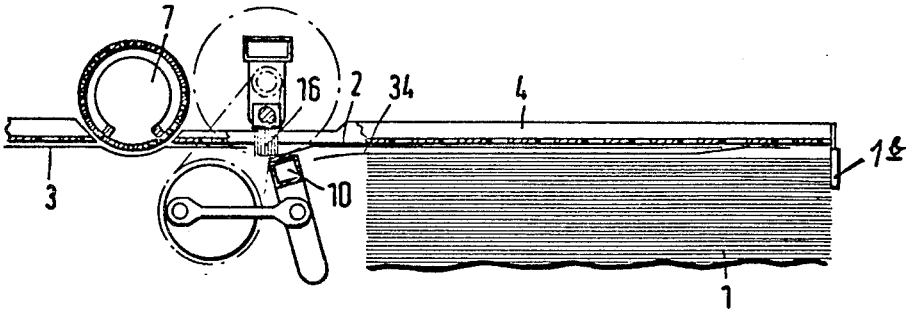
FIGS. 3–6 are all side views and respectively show the different phases of the sheet piling operation.

The different phases shown by FIGS. 3≠6 make it clear that the brushes 16 deflect the end of a sheet downwardly only during every second revolution of the rotative mount 19–20 in a counter clockwise direction as indicated by the arrow A in FIG. 4, the brushes rotating in a clockwise direction as indicated by the arrow B in FIG. 4, the orientation of the brushes relative to the rotative mount depending on the phase involved. The gear ratio selected determines whether the brushes 16 orbitally rotate to their action positions every second, third, fourth, etc., revolutions, the number, in turn, depending on the length of the sheets being handled.

When the end of the sheet 2 is gripped by the suction bar 10, and the next following sheet 3 is pushed with its leading edge over the trailing end of the gripped sheet, air can be blown by the nozzles 33 between these sheets and between the brushes and the sheet. This prevents the sheets from sticking together because of possible electrostatic charges. It also makes the overlapping easier.

Figure 5:
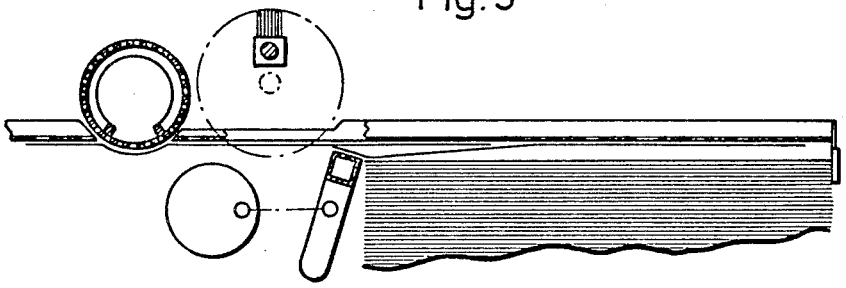
Figure 6:
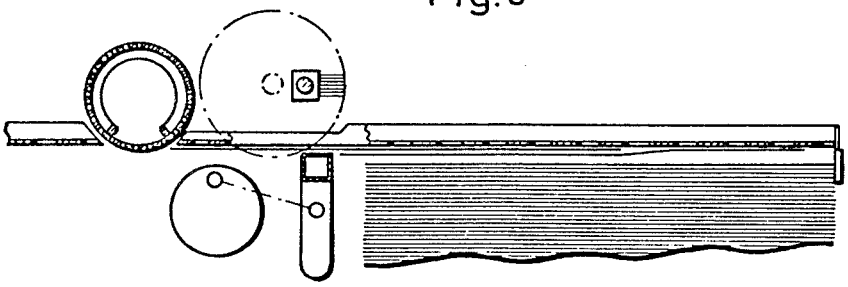

When the sheet to be decelerated has reached the position shown in FIG. 5, the vacuum applied to the suction bar 10 is terminated so that the bar can be moved from the position shown in FIG. 6 back to the position shown in FIG. 3 where the vacuum is reestablished so as to be prepared for the next sheet.

Because the suction bar 10 is rectangular in shape, its forward side, or righthand side, as shown by the drawings, provides a pushing surface inherently positioned to engage the trailing edge of any just previously fed sheet 34 which has not traveled fully to the stop 1*b* which aligns the sheets vertically, so as to push this sheet 34 completely into position as shown in FIG. 5.

I claim:

1. A sheet piler for superimposing and piling one on top of another horizontal sheets traveling one at a time in end-to-end relationship beneath laterally interspaced horizontal suspension bars extending longitudinally and having means for blowing air over the sheets' top surfaces in a direction causing the sheets to float spaced beneath the bars and propelling means for causing the sheets to travel forwardly at a constant velocity, said device comprising a suction bar positioned transversely below the forwardly traveling sheets, means for reciprocating said bar in a plane parallel to the sheets' traveling direction with at least a forward stroke of lower velocity relative to said constant velocity, means for applying suction to said bar only during said forward stroke, a rotative mount extending transversely above the sheets and said suction bars, rotative depressing means for successively depressing the trailing ends of the sheets into contact with said bar so as to cause the sheets to be decelerated and then released at said lower velocity, said depressing means being carried for planetary revolution by said mount, and means for rotating said mount in synchronism with the sheets' travel and for causing said depressing means to rotate so as to orbitally revolve to sheet depressing positions only when the sheets' trailing ends travel above said suction bar during its said forward stroke.

2. The piler of claim 1 in which said depressing means comprise brushes positioned to dip down between said suspension bars as the brushes orbitally rotate to depressing positions.

3. The piler of claim 2 in which said bar has a flat top coated with a material increasing the grip of the suction bar on the sheets.

4. The piler of claim 2 having means for blowing air in a traveling direction of the sheets and between said brushes and the trailing ends of the sheets depressed by the brushes.

5. The piler of claim 1 in which said bar has a pushing surface positioned to engage the trailing edge of a sheet incompletely overlapping the pile and push the sheet into complete overlapping position during the bar's said forward stroke.

6. The piler of claims 1, 2, 3, 4, or 5 in which said suspension bars extend over the piled sheets.

* * * * *